US009580981B2

(12) United States Patent
Zhong et al.

(10) Patent No.: US 9,580,981 B2
(45) Date of Patent: Feb. 28, 2017

(54) LINER HANGER SYSTEM

(71) Applicant: Halliburton Energy Services, Inc., Houston, TX (US)

(72) Inventors: Xiaoguang Allan Zhong, Plano, TX (US); Daniel Keith Moeller, zuid-holland (NL)

(73) Assignee: Halliburton Energy Services, Inc., Houston, TX (US)

( * ) Notice: Subject to any disclaimer, the term of this patent is extended or adjusted under 35 U.S.C. 154(b) by 173 days.

(21) Appl. No.: 14/048,119

(22) Filed: Oct. 8, 2013

(65) Prior Publication Data

US 2014/0174763 A1 Jun. 26, 2014

Related U.S. Application Data

(63) Continuation of application No. PCT/US2012/071171, filed on Dec. 21, 2012.

(51) Int. Cl.
*E21B 43/10* (2006.01)
*E21B 23/01* (2006.01)

(52) U.S. Cl.
CPC ..... *E21B 23/01* (2013.01); *E21B 43/10* (2013.01); *E21B 43/103* (2013.01); *E21B 43/105* (2013.01); *E21B 43/108* (2013.01)

(58) Field of Classification Search
CPC ..... E21B 43/10; E21B 23/01; E21B 43/103; E21B 43/105; E21B 23/00; E21B 17/08
USPC ..... 166/382, 206, 207, 208
See application file for complete search history.

(56) References Cited

U.S. PATENT DOCUMENTS

| | | | | |
|---|---|---|---|---|
| 3,425,719 | A * | 2/1969 | Burton | F16L 13/161 285/382.2 |
| 4,311,194 | A | 1/1982 | White | |
| 4,934,459 | A * | 6/1990 | Baugh | E21B 23/01 166/380 |
| 6,457,532 | B1 * | 10/2002 | Simpson | B21D 17/04 166/207 |
| 7,114,559 | B2 * | 10/2006 | Sonnier et al. | 166/206 |
| 7,306,034 | B2 * | 12/2007 | Garcia | 166/206 |
| 2002/0079106 | A1 | 6/2002 | Simpson | |

(Continued)

FOREIGN PATENT DOCUMENTS

| | | | |
|---|---|---|---|
| CN | 201284624 | Y | 8/2009 |
| CN | 102482932 | A | 5/2012 |

(Continued)

OTHER PUBLICATIONS

International Search Report and Written Opinion, International Application No. PCT/US2012/071171, 13 pgs., Aug. 26, 2013.

(Continued)

*Primary Examiner* — Michael Wills, III
(74) *Attorney, Agent, or Firm* — Scott Richardson; Baker Botts L.L.P.

(57) ABSTRACT

An improved liner hanger system is disclosed. The improved liner hanger system comprises a liner hanger positioned within a casing. The liner hanger comprises a spiked portion having one or more spikes, wherein the spikes comprise a flat portion. At least one of the one or more spikes is expandable and the flat portion of each of the one or more spikes interfaces with the casing when the spike is in the expanded position. A liner is coupled to the liner hanger.

20 Claims, 3 Drawing Sheets

(56) References Cited

U.S. PATENT DOCUMENTS

| | | | | |
|---|---|---|---|---|
| 2003/0047320 | A1 | 3/2003 | Badrak et al. | |
| 2003/0047323 | A1* | 3/2003 | Jackson et al. | 166/380 |
| 2005/0127671 | A1* | 6/2005 | Ellington | E21B 17/02 285/382 |
| 2005/0263294 | A1 | 12/2005 | Braddick | |
| 2006/0124295 | A1 | 6/2006 | Maguire | |
| 2006/0162937 | A1* | 7/2006 | Costa | E21B 17/042 166/380 |
| 2009/0200041 | A1 | 8/2009 | Watson | |
| 2010/0089591 | A1* | 4/2010 | Thomson | E21B 17/08 166/382 |
| 2011/0088893 | A1* | 4/2011 | Gette et al. | 166/195 |
| 2011/0095485 | A1* | 4/2011 | Saylor, III | E21B 33/10 277/312 |
| 2012/0175846 | A1 | 7/2012 | Hedrick | |
| 2013/0180715 | A1* | 7/2013 | Harris | E21B 23/01 166/285 |
| 2015/0218903 | A1* | 8/2015 | Sellers, Jr. | F16J 15/164 166/380 |

FOREIGN PATENT DOCUMENTS

| | | | |
|---|---|---|---|
| CN | 102575512 | A | 7/2012 |
| WO | 0037772 | A1 | 6/2000 |

OTHER PUBLICATIONS

International Preliminary Report on Patentability issued in related PCT Application No. PCT/US2012/071171, mailed Jul. 2, 2015 (10 pages).

Examination Report issued in Australian patent application No. 2012397228, mailed on Dec. 8, 2015 (3 pages).

Official Action issued in Chinese patent application No. 201280077208.2, mailed on Jan. 4, 2016 (19 pages with translation).

Written Opinion issued in related Singapore Application No. 11201504211V, mailed Jul. 11, 2016 (6 pages).

Office Action issued in related Chinese Application No. 2012800772082, mailed Sep. 5, 2016 (18 pages).

Extended European Search Report issued in related European Application No. 12890440.6, mailed Oct. 21, 2016 (7 pages).

* cited by examiner

LINER HANGER SYSTEM

CROSS-REFERENCE TO RELATED APPLICATION

This application is a continuation application of PCT Application No. PCT/US2012/071171, filed Dec. 21, 2012, the entire contents of which is incorporated by reference.

BACKGROUND

The present disclosure relates generally to equipment utilized and operations performed in conjunction with a subterranean well and, more particularly, to an improved liner hanger system.

When performing subterranean operations, a wellbore is typically drilled and completed to facilitate removal of desired materials (e.g., hydrocarbons) from a subterranean formation. Often, once a wellbore is drilled, a casing may be inserted into the wellbore. Cement may then be used to install the casing in the wellbore and prevent migration of fluids in the annulus between the casing and the wellbore wall. In certain implementations, the casing may be made of heavy steel.

Once an upper portion of the wellbore has been drilled and cased, it may be desirable to continue drilling and to line a lower portion of the wellbore with a liner lowered through the upper cased portion thereof. Liner hangers are typically used to mechanically support an upper end of the liner from the lower end of a previously installed casing. Additionally, liner hangers may be used to seal the liner to the casing.

Traditional liner hangers utilized slips for mechanically supporting the liner from the casing and packers to seal the different components. Expandable liner hangers ("ELH(s)") such as VERSAFLEX™, available from Halliburton Energy Services, have been recently developed and provide an improvement over traditional liner hangers. Specifically, ELHs utilize elastomeric rings (e.g., rings made of rubber) carried on a section of expandable tubing to provide both mechanical support and a fluid seal. Accordingly, once an ELH is placed at a desired position downhole within a casing, an expansion cone may be forced through the ELH. The expansion cone expands the elastomeric rings of the ELH, bringing them into contact with the casing to provide both mechanical support and a fluid seal between the casing and a liner.

It is often desirable to use an ELH in a larger size casing (e.g., casing having a diameter of between approximately 5.5" and approximately 22") and/or a high pressure high temperature ("HPHT") environment downhole. However, the properties of elastomeric rings of an ELH are often susceptible to changes in pressure and temperature. Accordingly, the high pressures and high temperatures of HPHT environments can adversely impact the ELH's ability to provide mechanical support and/or seal the liner to the casing. These adverse impacts become even more pronounced in instances when the liner is installed in a large casing.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features.

Figure 1:
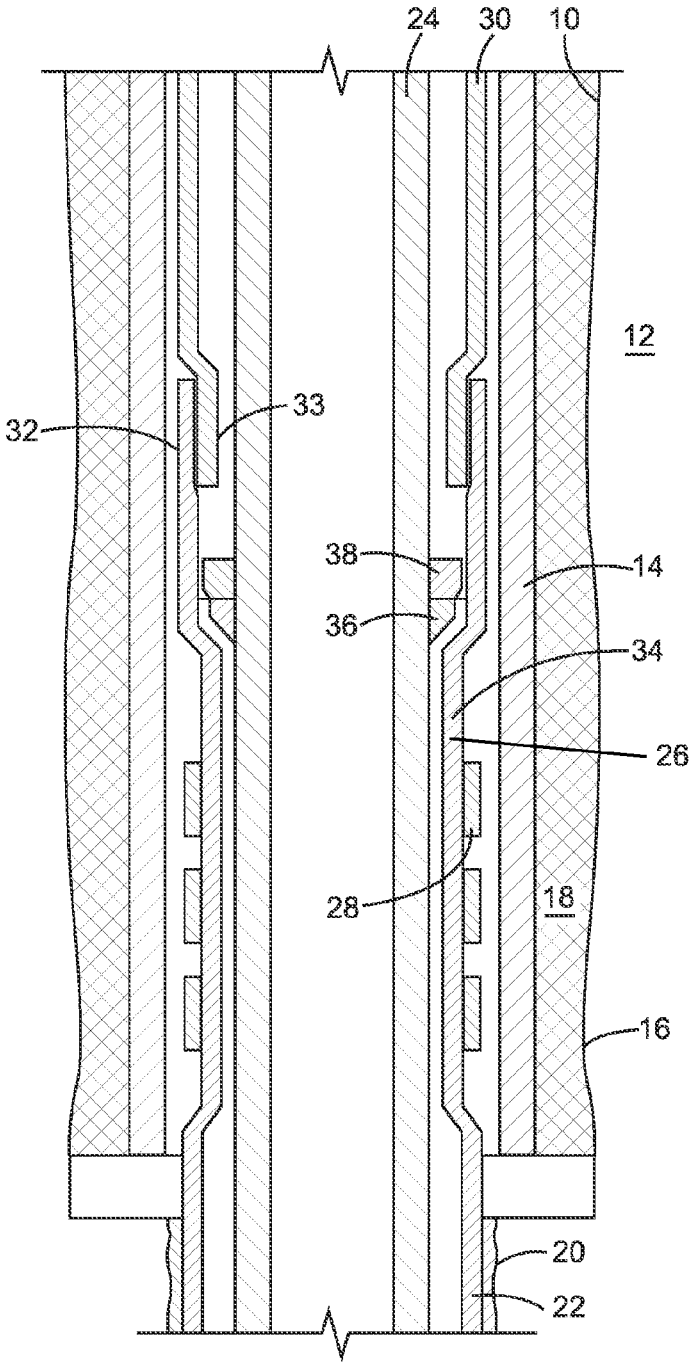
(Prior Art) Fig. 1
FIG. 1 is a cross-sectional view of a liner hanger system in accordance with the prior art.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to equipment utilized and operations performed in conjunction with a subterranean well and, more particularly, to an improved liner hanger system.

Illustrative embodiments of the present disclosure are described in detail below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Devices and methods in accordance with certain embodiments may be used in one or more of wireline, measurement-while-drilling (MWD) and logging-while-drilling (LWD) operations. Certain embodiments according to the present disclosure may provide for a single trip liner setting and drilling assembly.

The terms "couple" or "couples" as used herein are intended to mean either an indirect or a direct connection. Thus, if a first device couples to a second device, that connection may be through a direct connection, or through an indirect electrical or mechanical connection via other devices and connections. The term "wellbore" as used herein refers to any hole drilled into a formation for the purpose of exploration or extraction of natural resources such as, for example, hydrocarbons. The term "uphole" as used herein means along the drillstring or the hole from the distal end towards the surface, and "downhole" as used herein means along the drillstring or the hole from the surface towards the distal end.

It will be understood that the term "oil well drilling equipment" or "oil well drilling system" is not intended to limit the use of the equipment and processes described with those terms to drilling an oil well. The terms also encompass drilling natural gas wells or hydrocarbon wells in general. Further, such wells can be used for production, monitoring, or injection in relation to the recovery of hydrocarbons or other materials from the subsurface. This could also include geothermal wells intended to provide a source of heat energy instead of hydrocarbons. Embodiments may be applicable to injection wells as well as production wells, including hydrocarbon wells.

FIG. 1 depicts an ELH in accordance with the prior art. As shown in FIG. 1, a wellbore 10 may be drilled through earth formation 12. A casing 14 may then be placed in an upper portion 16 of the well 10 and held in place by cement 18 which is injected between the casing 14 and the upper portion 16 of well 10.

Below casing 14, a lower portion 20 of the wellbore 10 may be drilled through casing 14, The lower portion 20 may have a smaller diameter than the upper portion 16. A length of liner 22 is shown positioned within the lower portion 20. The liner 22 may be used to line or case the lower portion 20 and/or to drill the lower portion 20. If desired, cement may be placed between the liner 22 and lower portion 20 of wellbore 10. The liner 22 may be installed in the wellbore 10 by means of a work string 24. The work string 24 may include a releasable collet, not shown, by which it can support and rotate the liner 22 as it is placed in the wellbore 10.

Attached to the upper end of, or formed as an integral part of, liner 22 is a liner hanger 26 which may include a number of annular seals 28. While three seals 28 are depicted for illustrative purposes, any number of seals 28 may be used. A polished bore receptacle, or tie back receptacle, 30 may be coupled to the upper end of the liner hanger 26. In one embodiment, the polished bore receptacle 30 may be coupled to the liner hanger 26 by a threaded joint 32, but in other embodiments a different coupling mechanism may be employed. The inner bore of the polished bore receptacle 30 may be smooth and machined to close tolerance to permit work strings, production tubing, etc. to be connected to the liner 22 in a fluid-tight and pressure-tight manner. For instance, a work string may be connected by means of the polished bore receptacle 30 and used to pump fracturing fluid at high pressure down to the lower portion 20 of the wellbore 10 without exposing the casing 14 to the fracturing pressure.

It is desirable that the outer diameter of liner 22 be as large as possible while being able to lower the liner 22 through the casing 14. It is also desirable that the outer diameter of the polished bore receptacle 30 and the liner hanger 26 be about the same as the diameter of liner 22. In the run in condition, the outer diameter of liner hanger 26 is defined by the outer diameter of the annular seals 28. In the run in condition, a body or mandrel 34 of liner hanger 26 has an outer diameter reduced by about the thickness of the seals 28 so that the outer diameter of the seals is about the same as the outer diameter of liner 22 and tie back receptacle 30.

In this embodiment, first and second expansion cones 36 and 38 may be carried on the work string 24 just above the reduced diameter body 34 of the liner hanger 26. Fluid pressure applied between the work string 24 and the liner hanger 26 may be used to drive the cones 36, 38 downward through the liner hanger 26 to expand the body 34 to an outer diameter at which the seals 28 are forced into sealing and supporting contact with the casing 14. The first expansion cone 36 may be a solid, or fixed diameter, cone having a fixed outer diameter smaller than the inner diameter 33 of the threaded joint 32. In the run in condition, second expansion cone 38 may have an outer diameter greater than first cone 36 and also greater than the inner diameter 33 of the threaded joint 32. In an embodiment, the second expansion cone 38 may be collapsible, that is, may be reduced in diameter smaller than the inner diameter 33 of the threaded joint 32 when it needs to be withdrawn from the liner hanger 26. In some contexts, the second expansion cone 38 may be referred to as a collapsible expansion cone. After the liner hanger 26 is expanded, expansion cones 36, 38 may be withdrawn from the liner hanger 26, through the polished bore receptacle 30 and out of the wellbore 10 with the work string 24.

Figure 2:
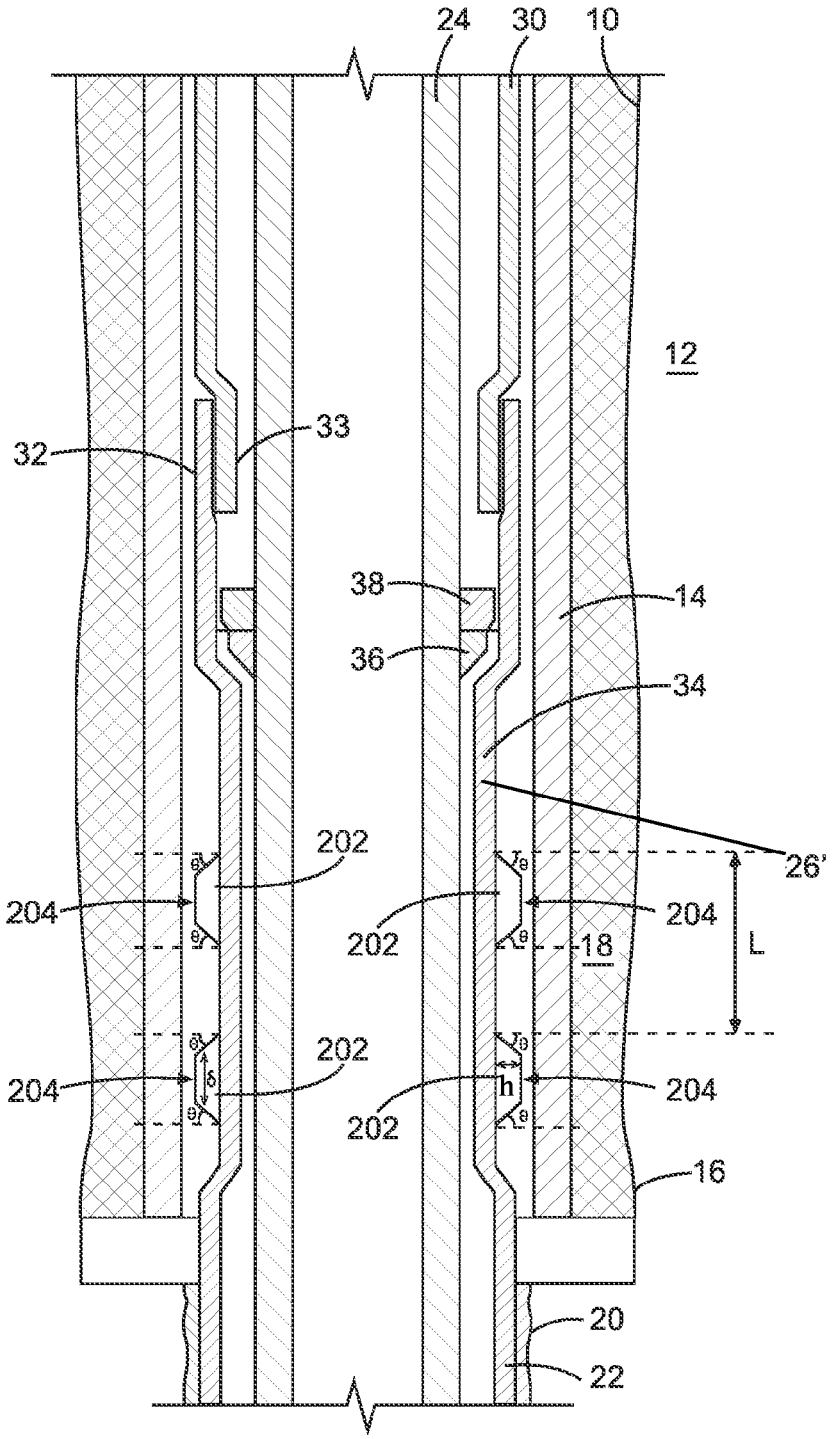
FIG. 2 is a cross-sectional view of a liner hanger system in accordance with an illustrative embodiment of the present disclosure.

Typical seals 28 are made of elastomeric elements (e.g., rubber) which as discussed above may be susceptible to degradation as a result of exposure to the high temperatures and high pressures downhole. In accordance with an embodiment of the present disclosure, the seals 28 may be replaced with one or more metallic spikes. FIG. 2 depicts a cross-sectional view of a system, including an improved liner hanger 26' where spikes 202 in accordance with an illustrative embodiment of the present disclosure have replaced the seals 28. The spikes 202 may be metal spikes. The metal spikes may be made of any suitable steel grade, aluminum, any other ductile material, and a combination thereof. In certain implementations, the spikes may be made from a combination of one or more of the recited materials. In certain embodiments, the spikes 202 may be made from AISI4140 steel or AISI4340 steel. In certain implementations, each spike 202 may be a circular ring that extends along an outer perimeter of the liner hanger 26' at a desired axial location. However, the present disclosure is not limited to this particular configuration of spikes 202. For instance, in certain embodiments, the spikes 202 may extend along an axial direction of the liner hanger 26'. Moreover, in certain implementations, the different spikes 202 may have different surface geometries without departing from the scope of the present disclosure. Specifically, a first spike may extend along an outer perimeter of the liner hanger 26' at a first axial position along the liner hanger 26' and a second spike may extend along an outer perimeter of the liner hanger 26' at a second axial position along the liner hanger 26'.

The spikes 202 may be formed using any suitable methods known to those of ordinary skill in the art. For instance, in certain implementations, the spikes 202 may be formed by machining the hanger body 26'. However, the present disclosure it not limited to machined spikes. In fact, any suitable methods known to one of ordinary skill in the art may be used to form the spikes 202. For instance, in certain implementations, the spikes 202 may be formed as a separate structure that can be coupled to the liner hanger 26' using any suitable coupling mechanisms known to one of ordinary skill in the art. Moreover, any number of spikes 202 may be formed along the axial direction of the liner hanger 26'. The number of spikes 202 formed along the axial direction of the liner hanger 26' may depend upon a number of factors such as, for example, the anchor load that is desired to be reached.

Accordingly, each of the spikes 202 provide a metal-to-metal seal between the liner hanger 26' and the casing 14. In certain implementations, the spikes 202 may have a flat top portion 204. The use of spikes 202 with a flat top portion 204 as opposed to pointed spikes or threads is beneficial because flat spikes 202 are less sensitive to casing variations and have a higher load capacity than pointed spikes. The spikes 202 may be symmetrically aligned such that an angle θ is the same on both sides of each spike 202 as shown in FIG. 2.

However, in certain implementations, the angle θ may be different on the opposing sides of the spike 202 without departing from the scope of the present disclosure. The angle θ is referred to herein as the "spike angle." In one embodiment, the spike angle (θ) is selected such that after expansion, the spikes 202 remain substantially normal to the liner hanger 26' body. For instance, in certain implementations, the spike angle (θ) may be selected to be in a range of from approximately 30° to approximately 70°.

Moreover, as shown in FIG. 2, the dimension δ denotes the width of the flat portion 204 of the spike 202 and is referred to herein as the spike width (δ). The spike width (δ) may be selected as desired such that the liner hanger 26' can expand without significant increase in expansion pressure while maintaining optimum contact area between the spikes 202 and the casing 14. Specifically, as the spikes 202 are expanded, the flat portion 204 of the spike interfaces with the inner surface of the casing 14 and will eventually couple the liner hanger 26' to the casing 14. The spikes 202 may be extended using one or more expansion cones in a manner similar to that disclosed in conjunction with expanding the seals 28 of FIG. 1. As shown in FIG. 2, the spacing between the spikes 202 along the length of the liner hanger 26' is denoted as "L". The distance between the spikes (L) may be configured such that the deformation zones in the casing 14 induced by the spikes 202 are isolated. The distance (L) may be selected to maximize the hanging capacity per spike. The term "hanging capacity" as used herein refers to the maximum downward load (anchor load) a hanger can carry without inducing an appreciable relative motion between the hanger 26' and the casing 14 after the hanger is set in the casing. Accordingly, in certain implementations, it may not be desirable for the distance between the spikes (L) to fall below a certain threshold value. For instance, in certain implementations, it may not be desirable for the distance between the spikes (L) to be less than three times the thickness of the casing 14. Accordingly, the distance (L) between the spikes 202 has an optimum value which is dependent upon a number of factors including, but not limited to, the outer diameter of the hanger (hanger OD), the hanger wall thickness, the inner diameter of the casing (casing ID) and the casing wall thickness. Moreover, the available length of the liner hanger 26' may limit the number of spikes 202 that may be placed thereon. Beyond this optimum value an increase in the distance (L) will no longer improve the hanging capacity per spike.

The height (H) of the spikes 202 (and their resulting outer diameter (OD)) may be configured to have dimensions similar to the seals 28. Specifically, in certain implementations, the height (H) of the spike (also referred to herein as "spike height") must be selected so that it is between an upper and a lower boundary. The upper spike height boundary may be selected as a function of the amount of flow area that is desired around the liner hanger 26' and the amount of possible rubber compression between the liner hanger 26' and the casing 14. In contrast, the lower spike height boundary may be selected as a function of the amount of rubber compression desired between the liner hanger 26' and the casing 14. Moreover, if the spike height is too large, it may destroy downhole equipment as it expands and if the spike height is too low, it wouldn't be able to support a liner as required. Configuration of the height (H) may cause a significant deformation of the spikes 202 and an appreciable localized plastic deformation of the casing. Once the spikes 202 of the liner hanger 26' are expanded, the spikes 202 and the inner diameter of the casing 14 form multiple metal-to-metal seals. The liner hanger 26' is coupled to the liner 22. Accordingly, the spikes 202 of the liner hanger 26' provide mechanical support for the liner 22.

Figure 3:
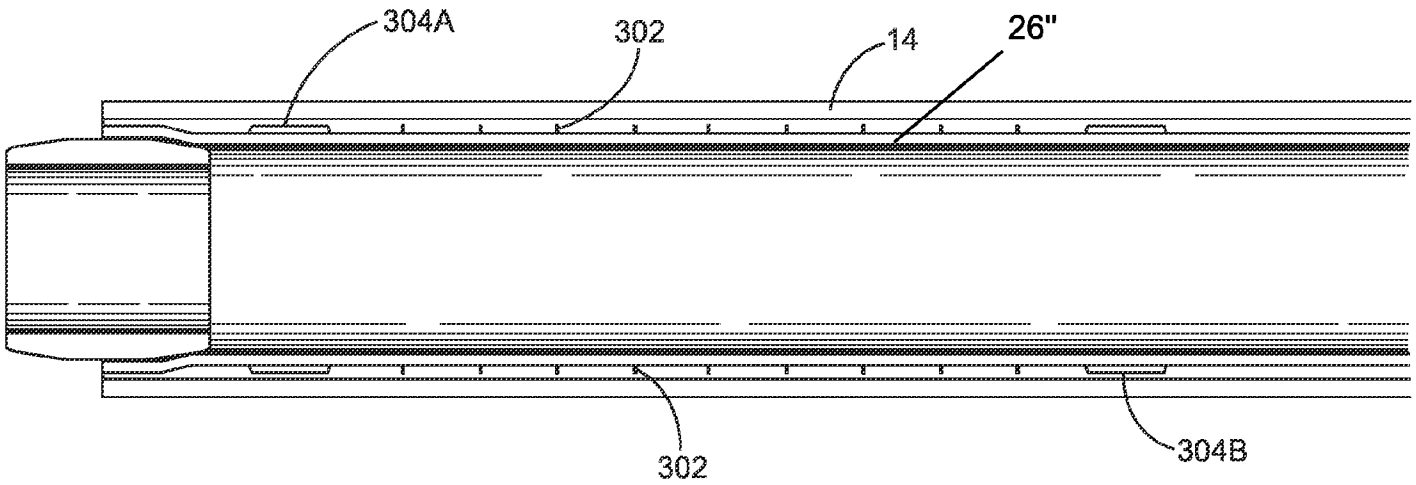
FIG. 3 is a cross-sectional view of spikes of a liner hanger in accordance with another illustrative embodiment of the present disclosure.

FIG. 3 depicts a partial cross-sectional view of a liner hanger 26" having spikes 302 in accordance with another implementation of the present disclosure. The spikes 302 may be configured in the same manner discussed above in conjunction with FIG. 2. The spikes 302 may be metal spikes. In certain implementations, each spike 302 may be a circular ring that extends along an outer perimeter of the liner hanger 26". The spikes 302 may be formed using any suitable methods known to those of ordinary skill in the art. For instance, in certain implementations, the spikes 302 may be formed by machining the hanger body 26". Moreover, any number of spikes 302 may be formed along the axial direction of the liner hanger 26". The number of spikes 302 formed along the axial direction of the liner hanger 26" may depend upon a number of factors such as, for example, the anchor load that is desired to be reached. Accordingly, each of the spikes 302 may provide a metal-to-metal seal between the liner hanger 26" and the casing 14.

In accordance with this implementation, a sealing element may be positioned at a desired location and utilized in conjunction with the spikes 302. For instance, in certain implementations, a sealing element 304 may be placed at an axial position on the liner hanger 26" above and/or below the spikes 302. The axial section of the liner hanger that contains the spikes 302 may be referred to herein as the "spiked portion." In the illustrative embodiment of FIG. 3, a first sealing element 304A and a second sealing element 304B are positioned at distal ends of the spiked portion. The placement of a sealing element at one or both of the distal ends of the spiked portion of the liner hanger 26" may provide redundancy and pressure integrity for the system.

This redundancy may be particularly beneficial in instances when one or more of the leading spikes 302 are damaged when the liner hanger 26" is being directed downhole.

The sealing element 304 may be made of any suitable material, including, but not limited to, rubber, extremely ductile metals (e.g., AISI type 316L stainless steel), other polymeric materials, or any other pliable material known to those of ordinary skill in the art. With the liner hanger spikes 302 in an expanded position, the sealing element 304 reinforces the seal between the liner 22 and the casing 14. The implementation of FIG. 3 may be particularly beneficial in instances when installed in a large size casing or a galled casing inner diameter having a pronounced inner diameter weld seam.

Although one sealing element 304 is shown in FIG. 3, as would be appreciated by those of ordinary skill in the art having the benefit of the present disclosure, two or more sealing elements 304 may be used between the spikes 302 without departing from the scope of the present disclosure. Moreover, the sealing element 304 may be positioned at any desired location along the liner hanger 26". For instance, one sealing element 304 may be positioned at an axial position on the liner hanger 26" uphole relative to the spiked portion and/or one sealing element 304 may be positioned at an axial position on the liner hanger 26" downhole relative to the spiked portion. In certain implementations, the sealing element 304 may be positioned such that there are equal number of spikes 302 provided uphole and downhole relative to the sealing element 304.

The metallic spikes 202, 302 of the improved liner hanger system (26' or 26") are much less susceptible to degradation than the traditional elastomeric seals 28 when exposed to high temperatures and/or pressures downhole. Moreover, the flat portion of the spikes 202, 302 minimizes the sensitivity of the liner hanger (26' or 26") to variations for a given weight casing. Accordingly, the improved liner hanger (26' or 26") provides several advantages. Not only does it provide an improved anchor load carrying capacity, it reduces the costs associated with performing operations using a liner hanger. Specifically, the use of metallic spikes instead of elastomeric seals 28 reduces the need for replacement of elastomeric elements 28 necessitated by performance of subterranean operations in HTHP environments downhole.

Moreover, the improved liner hanger (26' or 26") reduces the possibility of extruding long elastomers beyond the standard retainer spikes during expansion of the ELH. Specifically, as the liner hanger 26" expands, the spikes 302 and the sealing element 304 are also moved until they touch an Inner Diameter "ID" of the casing 14. As the expansion of the liner hanger 26" continues, the sealing element 304 is compressed along an axis of the liner hanger 26" and stretched along the perimeter of the liner hanger 26" due to pressure applied to it by the liner hanger 26", the inner wall of the casing 14 and the spikes 302 located at its two opposing lateral ends. Consequently, as the sealing element 304 is compressed, it will eventually spill over the spikes 302 located at its lateral ends. However, as the spikes 302 are also pushed out by the liner hanger 26", they cut off the spilled portion of the sealing element 304 and the new compressed volume of the sealing element is trapped between the liner hanger 26" and the casing 14.

Moreover, the use of expandable spikes (202, 302) in the liner hanger (26' or 26") is advantageous over using traditional mechanical mechanisms such as, for example, a gauge hanger. Specifically, in certain implementations, the expandable spikes provide a simple, single-part mechanism that forms a reliable and robust seal between the casing and the liner and supports the liner. Moreover, the use of spikes (202, 302) provides a robust seal in applications where the inner diameter of the casing 14 is imperfect.

Accordingly, once a wellbore is drilled in a subterranean operation, it may be cased using methods and systems known to those of ordinary skill in the art. For instance, a casing may be lowered into the wellbore and cemented in place. A liner coupled to a liner hanger in accordance with an implementation of the present disclosure may then be lowered downhole through a casing. Once the liner reaches a desired position downhole, the metal spikes extending along the perimeter of the liner hanger expand. Once the metal hangers are expanded, the flat portion of the spikes forms a metal-to-metal seal with an inner surface of the casing. This metal-to-metal seal couples the liner to the casing.

Although the figures depict embodiments of the present disclosure in a particular orientation, it should be understood by those skilled in the art that embodiments of the present disclosure are well suited for use in a variety of orientations. Further, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that the particular article introduces; and subsequent use of the definite article "the" is not intended to negate that meaning.

What is claimed is:

1. A system for performing subterranean operations comprising:

a liner hanger positioned within a casing, wherein the liner hanger comprises a spiked portion having one or more metallic spikes, each of the one or more metallic spikes extending in a circular ring along an outer perimeter of the liner hanger;

wherein the one or more metallic spikes are tapered to a flat portion, wherein at least one of the one or more metallic spikes is expandable, and wherein the flat portion of each of the one or more metallic spikes deforms the casing when the spike is in the expanded position, wherein each of the one or more metallic spikes provides a metal-to-metal seal between the liner hanger and the casing when the spike is in the expanded position; and a liner coupled to the liner hanger.

2. The system of claim 1, wherein the one or more metallic spikes are made from a material selected from a group consisting of Aluminum, steel, and a combination thereof.

3. The system of claim 1, wherein expanding the one or more metallic spikes couples the liner hanger to the casing.

4. The system of claim 1, wherein a spike angle of one or more metallic spikes is selected such that the spike is substantially normal to the liner hanger when the spike is in the expanded position.

5. The system of claim 1, further comprising a sealing element, wherein the sealing element is positioned at a distal end of the spiked portion.

6. The system of claim 5, wherein the sealing element is selected from a group consisting of rubber, polymeric materials and ductile metals.

7. The system of claim 1, wherein the one or more metallic spikes comprise a first spike positioned at a first axial location along the liner hanger and a second spike positioned at a second axial location along the liner hanger.

8. A method for coupling a liner to a casing of a cased wellbore in a subterranean formation comprising:

coupling a liner hanger to the liner, wherein the liner hanger comprises a spiked portion having a first metal spike tapered to a flat portion;

lowering the liner and the liner hanger downhole through the casing; and expanding the first metal spike, wherein the first metal spike causes deformation of the casing and provides a metal-to-metal seal between the liner hanger and the casing when the first metal spike is in the expanded position, and wherein expanding the first metal spike couples the liner hanger to the casing.

9. The method of claim 8, wherein a spike angle of one or more metallic spikes is selected such that the spike is substantially normal to the liner hanger when the spike is in the expanded position.

10. The method of claim 8, further comprising a sealing element, wherein the sealing element is positioned at a distal end of the spiked portion.

11. The method of claim 8, wherein the spiked portion further comprises a second metal spike extending in a circular ring along an outer perimeter of the liner hanger, wherein the first metal spike is positioned at a first axial location along the liner hanger and the second metal spike is positioned at a second axial location along the liner hanger.

12. The method of claim 8, wherein the first metal spike is formed by machining.

13. The method of claim 8, wherein the first metal spike is made from a material selected from a group consisting of Aluminum, steel, and a combination thereof.

14. A system for supporting a liner in a casing comprising:

a liner hanger coupled to the liner;

a first metal spike and a second metal spike formed on a spiked portion of the liner hanger, wherein each of the first metal spike and the second metal spike tapered to a flat portion and extends in a circular ring along an outer perimeter of the liner hanger, wherein the first metal spike is positioned at a first axial location along the liner hanger and the second metal spike is positioned at a second axial location along the liner hanger, wherein expanding at least one of the first metal spike and the second metal spike deforms the casing to couples the liner to the casing, and wherein each of the first metal spike and the second metal spike provides a metal-to-metal seal between the liner hanger and the casing when in the expanded position.

15. The system of claim 14, wherein a spike angle of one or more metallic spikes is selected such that the spike is substantially normal to the liner hanger when the spike is in the expanded position.

16. The system of claim 14, further comprising a sealing element, wherein the sealing element is positioned at a distal end of the spiked portion.

17. The system of claim 16, wherein the sealing element is selected from a group consisting of rubber, polymeric materials and ductile metals.

18. The system of claim 14, wherein at least one of the first metal spike and the second metal spike is formed by machining.

19. The system of claim 14, wherein at least one of the first metal spike and the second metal spike is made of a material selected from a group consisting of Aluminum, steel, and a combination thereof.

20. The system of claim 15, wherein the at least one of the first metal spike and the second metal spike are positioned at distal ends of the spiked portion.

* * * * *